US006347876B1

(12) United States Patent
Burton

(10) Patent No.: US 6,347,876 B1
(45) Date of Patent: Feb. 19, 2002

(54) LIGHTED MIRROR ASSEMBLY

(76) Inventor: Johnnie Burton, P.O. Box 2179, Calumet, IL (US) 60409-2179

( * ) Notice: Subject to any disclaimer, the term of this patent is extended or adjusted under 35 U.S.C. 154(b) by 0 days.

(21) Appl. No.: 09/595,463

(22) Filed: Jun. 16, 2000

(51) Int. Cl.[7] ..... F21V 33/00
(52) U.S. Cl. ..... 362/141; 362/413
(58) Field of Search ..... 362/128, 135, 362/140, 141, 144, 413; 359/854, 881

(56) References Cited

U.S. PATENT DOCUMENTS

| | | | | | |
|---|---|---|---|---|---|
| 404,110 | A | * | 5/1889 | Pincus | 362/141 |
| 896,658 | A | | 8/1908 | Mcgiehan | |
| 1,451,236 | A | | 4/1923 | Stanfield | |
| 1,555,478 | A | * | 9/1925 | Miller | 362/141 |
| 1,968,342 | A | * | 7/1934 | Herbold | 362/141 |
| 2,201,251 | A | * | 5/1940 | Van Patten | 362/141 |
| 2,598,291 | A | * | 5/1952 | O'Brien | 359/854 |
| 3,368,068 | A | * | 2/1968 | Cronheim | 362/141 |
| 3,714,411 | A | | 1/1973 | Waters et al. | |
| 4,119,107 | A | * | 10/1978 | Pinzone et al. | 362/140 |
| 4,269,382 | A | | 5/1981 | Coulson | |
| D307,358 | S | | 4/1990 | Gertson | |
| 5,359,461 | A | | 10/1994 | Rice et al. | |

* cited by examiner

*Primary Examiner*—Sandra O'Shea
*Assistant Examiner*—Peggy Neils

(57) ABSTRACT

A lighted mirror assembly for hands-free viewing of the back and sides of the head while cutting or styling hair. The lighted mirror assembly includes a base, a pole extending from the base, a mirror assembly with a plurality of mirrors, and a plurality of light assemblies.

10 Claims, 2 Drawing Sheets

LIGHTED MIRROR ASSEMBLY

BACKGROUND OF THE INVENTION

1. Field of the Invention

The present invention relates to mirrors and more particularly pertains to a new lighted mirror assembly for hands-free viewing of the back and sides of the head while cutting or styling hair.

2. Description of the Prior Art

The use of mirrors is known in the prior art. More specifically, mirrors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,359,461; U.S. Pat. No. 4,269,382; U.S. Pat. No. Des. 307,358; U.S. Pat. No. 3,714,411; U.S. Pat. No. 896,658; and U.S. Pat. No. 1,451,236.

While these devices fulfill their respective, particular objectives and requirements, the aforementioned patents do not disclose a new lighted mirror assembly. The inventive device includes a base, a pole extending from the base, a mirror assembly with a plurality of mirrors, and a plurality of light assemblies.

In these respects, the lighted mirror assembly according to the present invention substantially departs from the conventional concepts and designs of the prior art, and in so doing provides an apparatus primarily developed for the purpose of hands-free viewing of the back and sides of the head while cutting or styling hair.

SUMMARY OF THE INVENTION

In view of the foregoing disadvantages inherent in the known types of mirrors now present in the prior art, the present invention provides a new lighted mirror assembly construction wherein the same can be utilized for hands-free viewing of the back and sides of the head while cutting or styling hair.

The general purpose of the present invention, which will be described subsequently in greater detail, is to provide a new lighted mirror assembly apparatus and method which has many of the advantages of the mirrors mentioned heretofore and many novel features that result in a new lighted mirror assembly which is not anticipated, rendered obvious, suggested, or even implied by any of the prior art mirrors, either alone or in any combination thereof.

To attain this, the present invention generally comprises a base, a pole extending from the base, a mirror assembly with a plurality of mirrors, and a plurality of light assemblies.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lighted mirror assembly apparatus and method which has many of the advantages of the mirrors mentioned heretofore and many novel features that result in a new lighted mirror assembly which is not anticipated, rendered obvious, suggested, or even implied by any of the prior art mirrors, either alone or in any combination thereof.

It is another object of the present invention to provide a new lighted mirror assembly which may be easily and efficiently manufactured and marketed.

It is a further object of the present invention to provide a new lighted mirror assembly which is of a durable and reliable construction.

An even further object of the present invention is to provide a new lighted mirror assembly which is susceptible of a low cost of manufacture with regard to both materials and labor, and which accordingly is then susceptible of low prices of sale to the consuming public, thereby making such lighted mirror assembly economically available to the buying public.

Still yet another object of the present invention is to provide a new lighted mirror assembly which provides in the apparatuses and methods of the prior art some of the advantages thereof, while simultaneously overcoming some of the disadvantages normally associated therewith.

Still another object of the present invention is to provide a new lighted mirror assembly for hands-free viewing of the back and sides of the head while cutting or styling hair.

Yet another object of the present invention is to provide a new lighted mirror assembly which includes a base, a pole extending from the base, a mirror assembly with a plurality of mirrors, and a plurality of light assemblies.

Still yet another object of the present invention is to provide a new lighted mirror assembly that has an adjustable height to accommodate the varying needs of the user.

Even still another object of the present invention is to provide a new lighted mirror assembly that selectively provides a magnified view of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
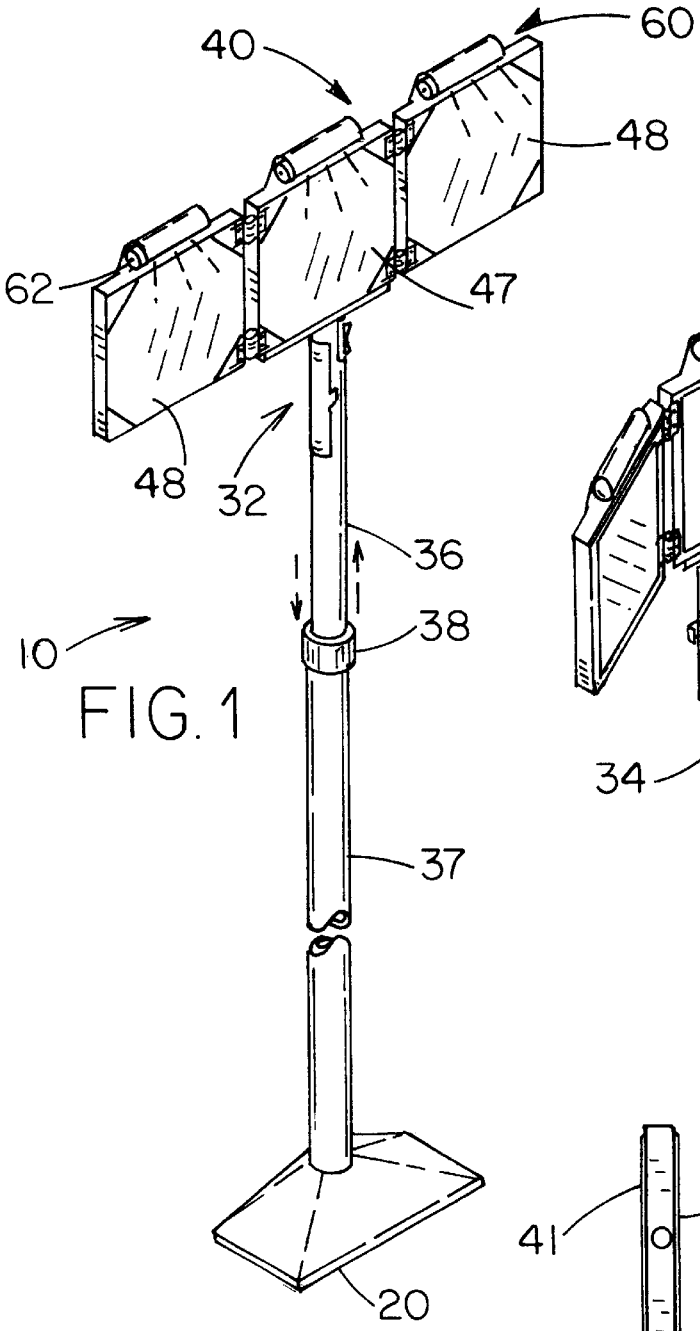
FIG. 1 is a schematic perspective view of a new lighted mirror assembly according to the present invention.
Figure 2:
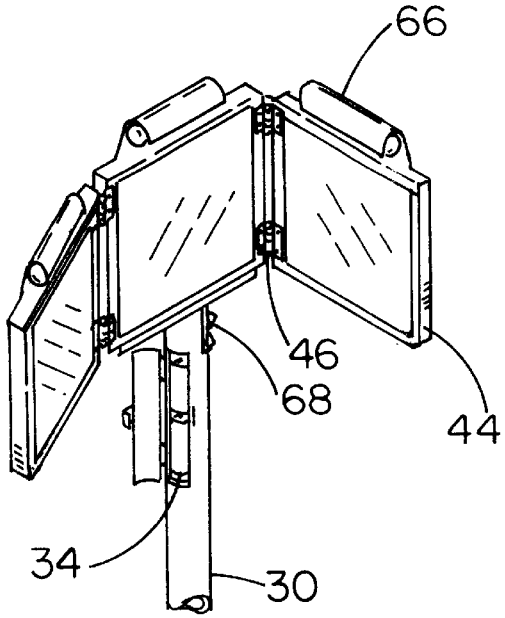
FIG. 2 is a schematic detail view of the mirror assembly and battery compartment of the present invention.
Figure 3:
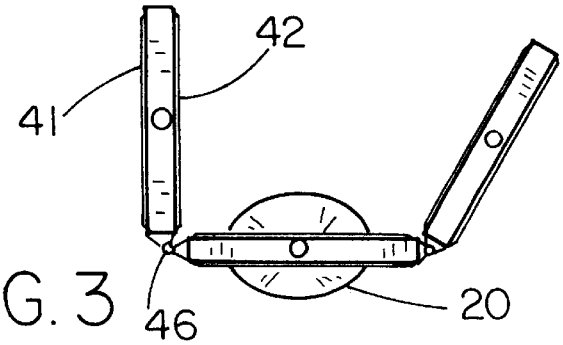
FIG. 3 is a schematic top view of the present invention.
Figure 4:
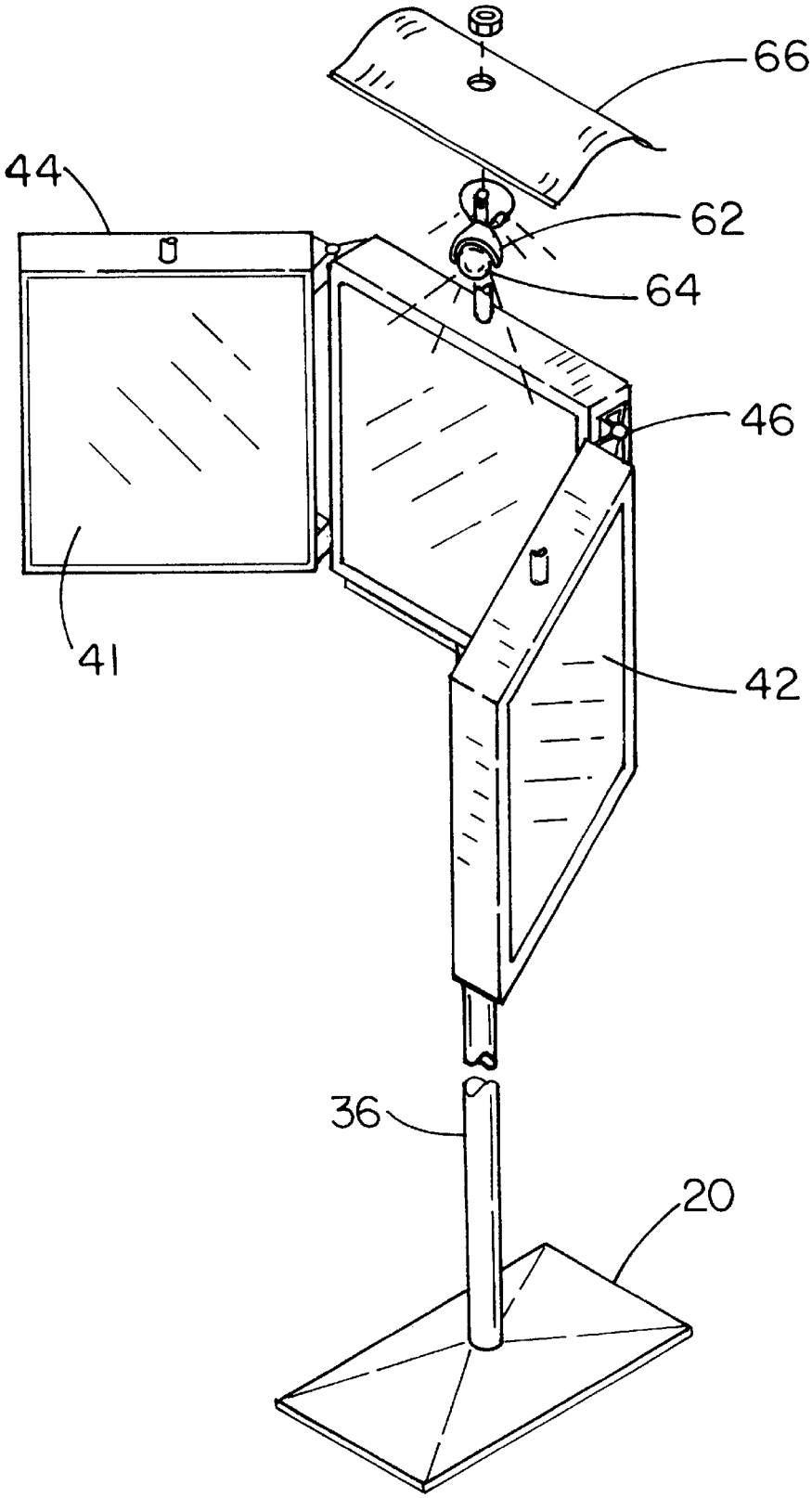
FIG. 4 is a schematic perspective view of the present invention.

With reference now to the drawings, and in particular to FIGS. 1 through 4 thereof, a new lighted mirror assembly embodying the principles and concepts of the present invention and generally designated by the reference numeral 10 will be described.

As best illustrated in FIGS. 1 through 4, the lighted mirror assembly 10 generally comprises a base 20, a telescopic pole 30 extending from the base 20, a mirror assembly 40, and a plurality of light assemblies 50.

In an embodiment the base 20 is generally rectangular in shape.

In a further embodiment the base 20 is generally elliptical in shape.

The mirror assembly 40 coupled to the top of the pole 30. The mirror assembly 40 includes a plurality of mirrors, a plurality of hinges 46 and a frame 44 around each of the plurality of mirrors.

The mirror assembly 40 includes a central mirror 47 and a pair of outer mirrors 48 pivotally coupled to the central mirror 47 for permitting adjustment of the outer mirrors 48 to provide side views of an object positioned in front of the central mirror 47.

Each of the mirrors includes a first reflective surface 41 for reflecting a true image of an object positioned in front of the first reflective surface 41. Each of the mirrors further includes a second reflective surface 42 on an opposite face of the mirror. The second reflective surface 42 is for reflecting a magnified image of an object positioned in front of the second reflective surface 42.

Each of the plurality of light assembly 60 is coupled to an associated one of the plurality of mirrors for illuminating a reflective surface of the associated mirror.

In an embodiment the light assemblies 60 include a pair of lamp sockets 62, a pair of lamps 64, and a shroud member 66 positioned over the pair of lamps 64. The lamps 64 are positioned in such a manner that the light from the first lamp is directed generally towards the first reflecting surface 41 of the mirror, and the light from the second lamp is directed generally towards the second reflecting surface 42 of the mirror.

In a further embodiment the light assembly 60 includes a shroud member 66 which has a generally C-shaped cross section. The shroud member 66 extends from the top of the associated mirror such that the opening of the shroud 66 directs the light towards the reflective surface 41 of the mirror.

A battery compartment 32 is positioned in an upper portion 36 of the pole 30. A battery 34 is positionable in the battery compartment 32. The battery 34 is electrically coupled to each of the light assemblies 60 for providing power to the light assemblies 60.

An on/off switch 68 is coupled to the upper portion 36 of the pole 30. The on/off switch 68 is electrically coupled between the battery 34 and each of the light assemblies 60. Thus the light assemblies 60 are activatable by closing the on/off switch 68 and the light assemblies 60 are deactivatable by opening the on/off switch 68.

The pole 30 includes a generally hollow cylindrical lower portion 37 and a generally cylindrical upper portion 36 slidably insertable into the lower portion 37.

A locking mechanism 38 is used to hold the upper portion 36 in a static position relative to the lower portion 37.

Each of the mirrors is coupled to an adjacently positioned mirror by a pair of the hinges 46. One of the pair of hinges 46 is positioned proximate to the top of the pair of adjacently positioned mirrors and a second one of the pair of hinges 46 is positioned proximate to the bottom of the pair of adjacently positioned mirrors.

In use, the user positions the lighted mirror assembly in such a manner that it is facing another mirror. The user assumes a position between the mirror and the lighted mirror assembly. The user then adjusts the height of the lighted mirror assembly by loosening the locking mechanism and sliding the upper portion of the pole with respect to the lower portion of the pole. Once the height has been adjusted, the user then adjusts the position of the two outer mirrors in such a manner that the rear of the users head is observable in the central mirror and the sides of the users head are observable in the outer mirrors when viewed through the mirror.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighted mirror assembly comprising:

a base;

a pole extending from said base;

a mirror assembly coupled to a top of said pole, said mirror assembly having a plurality of mirrors;

a plurality of light assemblies, each light assembly being coupled to an associated one of said plurality of mirrors for illuminating a reflective surface of said associated mirror;

one of said mirrors having a first reflective surface for reflecting a true image of an object positioned in front of said first reflective surface, said one of said mirrors further having a second reflective surface on an opposite face of said one of said mirrors, said second reflective surface being for reflecting a magnified image of an object positioned in front of said second reflective surface; and said light assemblies including a bi-directional light assembly coupled to said one of said mirrors having said first and second reflective surfaces, said bidirectional light assembly including a pair of lamp sockets, a pair of lamps, and a shroud member positioned over said pair of lamps when said lamps are coupled to said lamp sockets such that light from a first one of said lamps is directed generally towards said first reflective surface and light from a second one of said pair of lamps is generally directed towards said second reflective surface.

2. The lighted mirror assembly of claim 1, further comprising:

said pole being telescopic.

3. The lighted mirror assembly of claim 1, further comprising:

said mirror assembly including a central mirror and a pair of outer mirrors pivotally coupled to said central mirror for permitting adjustment of said outer mirrors to provide side views of an object positioned in front of said central mirror.

4. The lighted mirror assembly of claim 1, further comprising:

a battery compartment positioned in an upper portion of said pole; and a battery positionable in said battery compartment, said battery being electrically coupled to each of said light assemblies for providing power to said light assemblies.

5. The lighted mirror assembly of claim 4, further comprising:

an on/off switch coupled to said upper portion of said pole, said on/off switch being electrically coupled between said battery and each of said light assemblies whereby said light assemblies are activatable by closing said on/off switch and said light assemblies are deactivatable by opening said on/off switch.

6. The lighted mirror assembly of claim 1, wherein each of said light assemblies comprises:

a lamp socket coupled to a top of said associated mirror;

a lamp coupled to said lamp socket; and a shroud member having a generally C-shaped cross-section, said shroud member extending from said top of said associated mirror, said shroud member extending over said lamp when said lamp is coupled to said lamp socket such that an opening of said shroud member directs light from said lamp towards said reflective surface of said associated mirror.

7. The lighted mirror assembly of claim 2, further comprising:

said pole including a generally hollow cylindrical lower portion and a generally cylindrical upper portion slidably insertable into said lower portion; and a locking mechanism for holding said upper portion in a static position relative to said lower portion.

8. The lighted mirror assembly of claim 3, further comprising:

a plurality of hinges, each of said mirrors being coupled to an adjacently positioned mirror by a pair of said hinges, one of said pair of hinges being positioned proximate a top of said pair of adjacently positioned mirrors and a second one of said pair of mirrors being positioned proximate a bottom of said pair of adjacently positioned mirrors.

9. A lighted mirror assembly comprising:

a base;

a telescopic pole extending from said base;

a mirror assembly coupled to a top of said pole, said mirror assembly having a plurality of mirrors;

a plurality of light assemblies, each light assembly being coupled to an associated one of said plurality of mirrors for illuminating a reflective surface of said associated mirror;

said mirror assembly including a central mirror and a pair of outer mirrors pivotally coupled to said central mirror for permitting adjustment of said outer mirrors to provide side views of an object positioned in front of said central mirror;

a battery compartment positioned in an upper portion of said pole;

a battery positionable in said battery compartment, said battery being electrically coupled to each of said light assemblies for providing power to said light assemblies;

an on/off switch coupled to said upper portion of said pole, said on/off switch being electrically coupled between said battery and each of said light assemblies whereby said light assemblies are activatable by closing said on/off switch and said light assemblies are deactivatable by opening said on/off switch;

each of said mirrors having a first reflective surface for reflecting a true image of an object positioned in front of said first reflective surface, each of said mirrors further having a second reflective surface on an opposite face of said mirror, said second reflective surface being for reflecting a magnified image of an object positioned in front of said second reflective surface;

said pole including a generally hollow cylindrical lower portion and a generally cylindrical upper portion slidably insertable into said lower portion;

a locking mechanism for holding said upper portion in a static position relative to said lower portion; and a plurality of hinges, each of said mirrors being coupled to an adjacently positioned mirror by a pair of said hinges, one of said pair of hinges being positioned proximate a top of said pair of adjacently positioned mirrors and a second one of said pair of mirrors being positioned proximate a bottom of said pair of adjacently positioned mirrors;

each of said light assemblies including a pair of lamp sockets, a pair of lamps, and a shroud member positioned over said pair of lamps when said lamps are coupled to said lamp sockets such that light from a first one of said lamps is directed generally towards said first reflective surface and light from a second one of said pair of lamps is generally directed towards said second reflective surface.

10. The lighted mirror assembly of claim 9, further comprising:

each of said light assemblies including a lamp socket coupled to a top of said associated mirror;

each of said light assemblies including a lamp coupled to said lamp socket; and each of said light assemblies including a shroud member having a generally C-shaped cross-section, said shroud member extending from said top of said associated mirror, said shroud member extending over said lamp when said lamp is coupled to said lamp socket such that an opening of said shroud member directs light from said lamp towards said reflective surface of said associated mirror.

* * * * *